US010891901B2

(12) United States Patent
Lee et al.

(10) Patent No.: US 10,891,901 B2
(45) Date of Patent: Jan. 12, 2021

(54) ORGANIC LIGHT EMITTING DISPLAY APPARATUS

(71) Applicant: LG Display Co., Ltd., Seoul (KR)

(72) Inventors: GeunWoo Lee, Paju-si (KR); YongKyu Park, Paju-si (KR); MunJun Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/553,790

(22) Filed: Aug. 28, 2019

(65) Prior Publication Data

US 2020/0082759 A1 Mar. 12, 2020

(30) Foreign Application Priority Data

Sep. 12, 2018 (KR) ..... 10-2018-0109111

(51) Int. Cl.
*G09G 3/3258* (2016.01)

(52) U.S. Cl.
CPC ... *G09G 3/3258* (2013.01); *G09G 2310/0205* (2013.01); *G09G 2310/0286* (2013.01); *G09G 2310/061* (2013.01); *G09G 2320/0238* (2013.01); *G09G 2320/0257* (2013.01); *G09G 2330/028* (2013.01)

(58) Field of Classification Search
CPC ..... G09G 3/3233; G09G 3/3266; G09G 2320/0261; G09G 2300/0814; G09G 2310/02–021; G09G 2310/0218
See application file for complete search history.

(56) References Cited

U.S. PATENT DOCUMENTS

| | | | | |
|---|---|---|---|---|
| 2016/0078834 | A1* | 3/2016 | Hong | G09G 3/20 345/212 |
| 2017/0345376 | A1* | 11/2017 | Tani | G09G 3/3266 |
| 2018/0053462 | A1 | 2/2018 | Bae et al. | |
| 2018/0061293 | A1* | 3/2018 | Park | G09G 3/3233 |
| 2018/0137825 | A1* | 5/2018 | An | G09G 3/3266 |

FOREIGN PATENT DOCUMENTS

| | | | |
|---|---|---|---|
| JP | 2006-301250 | A | 11/2006 |
| JP | 2009-210757 | A | 9/2009 |
| JP | 2017-198967 | A | 11/2017 |
| KR | 10-2018-0060530 | A | 6/2018 |

* cited by examiner

*Primary Examiner* — Sanjiv D. Patel
(74) *Attorney, Agent, or Firm* — Seed Intellectual Property Law Group LLP

(57) ABSTRACT

Disclosed is an organic light emitting display apparatus. The organic light emitting display apparatus outputs black gate pulses for a black image and sensing gate pulses for sensing in a vertical blank period and differently sets timings, at which the sensing gate pulses are output after the black gate pulses are output, for each gate line.

16 Claims, 7 Drawing Sheets

ORGANIC LIGHT EMITTING DISPLAY APPARATUS

BACKGROUND

Technical Field

The present disclosure relates to an organic light emitting display apparatus based on a black image mode which displays an image and then displays a black image during one frame period, for improving a motion picture response time (MPRT).

Description of the Related Art

In addition to liquid crystal display (LCD) apparatuses, organic light emitting display apparatuses have a problem where an image is not clearly seen due to the delay of a motion picture response time (MPRT).

In order to solve such a problem, a black image mode which displays an image and then displays a black image during one frame period is used.

In a related art, organic light emitting display apparatus, a characteristic deviation of a threshold voltage (Vth) or mobility of a driving transistor occurs in each pixel due to causes such as a process deviation and degradation. For this reason, the amounts of currents for respectively driving organic light emitting diodes differ, and due to this, a luminance deviation occurs between pixels.

In order to overcome such drawbacks, various kinds of compensation methods are used.

In order to apply the compensation methods, sensing image data voltages have to be output to an organic light emitting display panel in a vertical blank period, where image data voltages are not output, of one frame period Moreover, in an organic light emitting display apparatus using the black image mode, black image data voltages have to be output to the organic light emitting display panel in the vertical blank period.

However, in the related art organic light emitting display apparatus, all of the sensing image data voltages for compensating for mobility and the black image data voltages for applying the black image mode may not be output to the organic light emitting display panel in the vertical blank period.

BRIEF SUMMARY

Accordingly, various embodiments of the present disclosure are directed to providing an organic light emitting display apparatus that substantially obviates one or more problems due to limitations and disadvantages of the related art.

An aspect of the present disclosure is directed to providing an organic light emitting display apparatus which outputs black gate pulses for a black image and sensing gate pulses for sensing in a vertical blank period and differently sets timings, at which the sensing gate pulses are output after the black gate pulses are output, for each gate line.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, in various embodiments, the present disclosure provides an organic light emitting display apparatus including an organic light emitting display panel including a plurality of pixels each including an organic light emitting diode and a driving transistor for driving the organic light emitting diode, a gate driver outputting image gate pulses, which control outputs of image data voltages used to display an image, to gate lines included in the organic light emitting display panel in a first period of a first frame period, outputting the image gate pulses and black gate pulses for controlling outputs of black image data voltages used to display a black image in a second period arriving after the first period, and outputting a sensing gate pulse to one gate line connected to driving transistors, of which characteristic variation is to be sensed, in a third period until a first period of a second frame starts after the second period of the first frame period, a data driver outputting data voltages to data lines included in the organic light emitting display panel, and a controller controlling the gate driver and the data driver, wherein the gate driver includes a first driver generating the image gate pulses, the black gate pulses, and the sensing gate pulse by using first to eighth gate clocks transferred from the controller in the first frame period, a second driver generating the image gate pulses, the black gate pulses, and the sensing gate pulse by using ninth to sixteenth gate clocks transferred from the controller in the first frame period, and a third driver controlling the first driver and the second driver to output the sensing gate pulse in a third period of the first frame period.

According to various embodiments of the present disclosure, there is provided an organic light emitting display apparatus including an organic light emitting display panel including a plurality of pixels each including an organic light emitting diode and a driving transistor for driving the organic light emitting diode, a gate driver outputting image gate pulses, which control outputs of image data voltages used to display an image, to gate lines included in the organic light emitting display panel in a first period of a first frame period, outputting the image gate pulses and black gate pulses for controlling outputs of black image data voltages used to display a black image in a second period arriving after the first period, and outputting a sensing gate pulse to one gate line connected to driving transistors, of which characteristic variation is to be sensed, in a third period until a first period of a second frame starts after the second period of the first frame period, a data driver outputting data voltages to data lines included in the organic light emitting display panel, and a controller controlling the gate driver and the data driver, wherein a period until the sensing gate pulse is output to a sensing gate line after the black gate pulse is output in the third period of the first frame period differs from a period until the sensing gate pulse is output to another sensing gate line after the black gate pulse is output in a third period of the second frame period.

According to various embodiments, there is provided an organic light emitting display apparatus comprising: an organic light emitting display panel including a plurality of pixels, each of the pixels including an organic light emitting diode and a driving transistor for driving the organic light emitting diode; a gate driver configured to: output image gate pulses, which control outputs of image data voltages used to display an image, to a plurality of gate lines included in the organic light emitting display panel in a first period of a first frame period, output the image gate pulses and black gate pulses for controlling outputs of black image data voltages used to display a black image in a second period of the first frame period that is subsequent to the first period, and output a sensing gate pulse to one gate line of the plurality of gate lines connected to driving transistors of a portion of the plurality of pixels, of which a characteristic variation is to be sensed, in a third period of the first frame period that is subsequent to the second period until a first period of a second frame starts; a data driver configured to output data voltages to a plurality of data lines included in the organic light emitting display panel; and a controller configured to control the gate driver and the data driver.

In some embodiments, the gate driver may include: a first driver configured to generate the image gate pulses, the black gate pulses, and the sensing gate pulse using a first set of gate clocks (which, in some embodiments, may be first to eighth gate clocks) provided by the controller in the first frame period; a second driver configured to generate the image gate pulses, the black gate pulses, and the sensing gate pulse using a second set of gate clocks (which, in some embodiments, may be ninth to sixteenth gate clocks) provided by the controller in the first frame period; and a third driver configured to control the first driver and the second driver to output the sensing gate pulse in the third period of the first frame period.

According to various embodiments, the data driver outputs the image data voltages in the first period, outputs the image data voltages or the black image data voltages in the second period, and outputs sensing image data voltages for displaying a sensing image or the black image data voltages in the third period.

According to various embodiments, the black gate pulses are output from the second period of the first frame period to at least part of a first period of the second frame period.

According to various embodiments, the third driver selects a sensing gate line, to which the sensing gate pulse is to be output, from among the plurality of gate lines based on a line selection signal provided by the controller and controls the first driver or the second driver based on a reset signal provided by the controller so that the first driver or the second driver outputs the sensing gate pulse to the selected sensing gate line.

According to various embodiments, the controller outputs the line selection signal to the third driver at a timing at which a gate clock, corresponding to an image gate pulse output to the sensing gate line in the first period or the second period of the first frame period, of the gate clocks is output to the first driver or the second driver.

According to various embodiments, when the sensing gate pulse is output from the first driver, the controller selects, as a sensing-enabled period, one period of a first sleeping period and provides the reset signal, indicating the start of the sensing-enabled period, to the third driver, wherein the first sleeping period is a period between a period in which the second driver outputs black gate pulses after the first driver is driven for outputting the black gate pulses and a period in which the first driver is again driven for outputting the black gate pulses, in the third period.

According to various embodiments, when the sensing gate pulse is output from the second driver, the controller selects, as a sensing-enabled period, one period of a second sleeping period and provides the reset signal, indicating the start of the sensing-enabled period, to the third driver, wherein the second sleeping period is a period between a period in which the first driver outputs black gate pulses after the second driver is driven for outputting the black gate pulses and a period in which the second driver is again driven for outputting the black gate pulses, in the third period.

According to various embodiments, a period until the sensing gate pulse is output to a sensing gate line after the black gate pulse is output in the third period of the first frame period differs from a period until the sensing gate pulse is output to another sensing gate line after the black gate pulse is output in a third period of the second frame period.

According to various embodiments, at least one of the first driver or the second driver simultaneously outputs the black gate pulses to eight gate lines of the plurality of gate lines.

According to various embodiments, the first driver generates the image gate pulses using first to eighth gate clocks, and the second driver generates the image gate pulses using ninth to sixteenth gate clocks.

According to various embodiments, an interval between a fourth image gate pulse and a fifth image gate pulse output from the first driver is greater than an interval between other consecutive image gate pulses output from the first driver, and an interval between a twelfth gate clock and a thirteenth gate clock output from the second driver is greater than an interval between other consecutive image gate pulses output from the second driver.

According to various embodiments, the first driver outputs the black gate pulse in a period between a period in which the fourth gate clock is output and a period in which the fifth gate clock is output, and the second driver outputs the black gate pulse in a period between a period in which the twelfth gate clock is output and a period in which the thirteenth gate clock is output.

According to various embodiments, there is provided an organic light emitting display apparatus comprising: an organic light emitting display panel including a plurality of pixels each including an organic light emitting diode and a driving transistor for driving the organic light emitting diode; a gate driver outputting image gate pulses, which control outputs of image data voltages used to display an image, to gate lines included in the organic light emitting display panel in a first period of a first frame period, outputting the image gate pulses and black gate pulses for controlling outputs of black image data voltages used to display a black image in a second period arriving after the first period, and outputting a sensing gate pulse to one gate line connected to driving transistors, of which characteristic variation is to be sensed, in a third period until a first period of a second frame starts after the second period of the first frame period; a data driver outputting data voltages to data lines included in the organic light emitting display panel; and a controller controlling the gate driver and the data driver, wherein a period until the sensing gate pulse is output to a sensing gate line after the black gate pulse is output in the third period of the first frame period differs from a period until the sensing gate pulse is output to another sensing gate line after the black gate pulse is output in a third period of the second frame period.

According to various embodiments, the black gate pulses are output in a period from the second period of the first frame period to a partial period of the first period of the second frame period.

According to various embodiments, the gate driver comprises: a first driver generating the image gate pulses, the black gate pulses, and the sensing gate pulse by using first to eighth gate clocks transferred from the controller in the first frame period; a second driver generating the image gate pulses, the black gate pulses, and the sensing gate pulse by using ninth to sixteenth gate clocks transferred from the controller in the first frame period; and a third driver controlling the first driver and the second driver to output the sensing gate pulse in a third period of the first frame period.

According to various embodiments, the first driver and the second driver alternately output sixteen image gate pulses.

According to various embodiments, the first driver and the second driver repeatedly perform the same function at a period corresponding to thirty-two image gate pulses.

According to various embodiments, when the first driver and the second driver alternately output sixteen image gate pulses, the first driver and the second driver repeatedly perform the same function at a period corresponding to thirty-two image gate pulses, and number of the gate lines is 2,160, a period where the gate pulses are output is expressed as 32n+16 (where n is a natural number equal to or less than 67), and when n is 67, all of 2,160 gate pulses are output.

According to various embodiments, the first driver outputs sixteen image gate pulses by using the first to eighth gate clocks, after the first driver outputs the sixteen image gate pulses, the second driver outputs sixteen image gate pulses by using the ninth to sixteenth gate clocks, after the second driver outputs the sixteen image gate pulses, the first driver outputs sixteen other image gate pulses by using the first to eighth gate clocks, and after the first driver outputs the sixteen other image gate pulses, the second driver outputs sixteen other image gate pulses by using the ninth to sixteenth gate clocks.

According to various embodiments, the first driver or the second driver simultaneously output the black gate pulses to eight gate lines.

It is to be understood that both the foregoing general description and the following detailed description of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
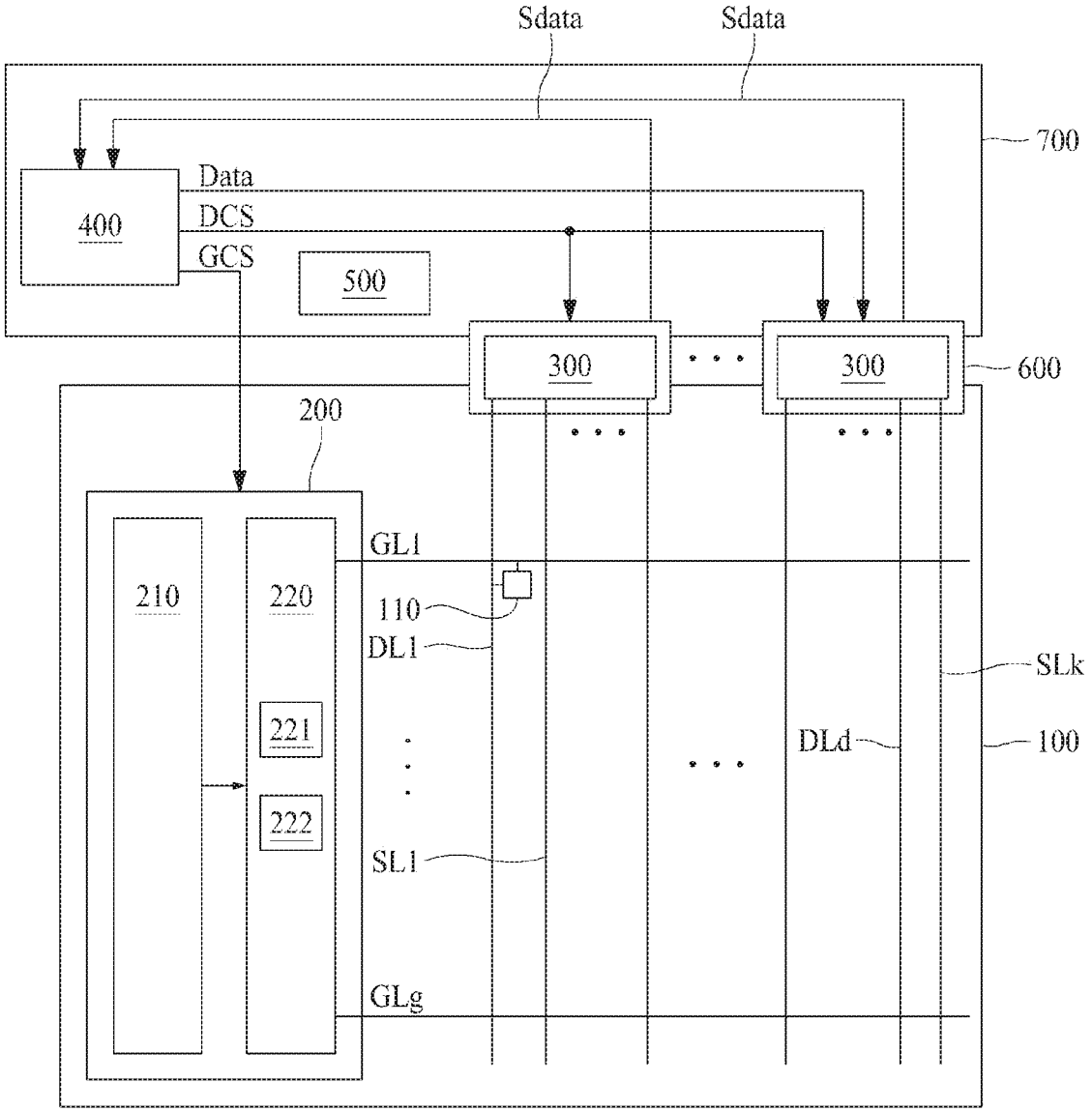
FIG. 1 is an exemplary diagram illustrating a configuration of an organic light emitting display apparatus according to the present disclosure.

Reference will now be made in detail to the exemplary embodiments of the present disclosure, examples of which are illustrated in the accompanying drawings. Wherever possible or convenient for description of embodiments provided herein, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

In the specification, in adding reference numerals for elements in each drawing, it should be noted that like reference numerals already used to denote like elements in other drawings are used for elements wherever possible.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless specifically limited to the contrary.

In construing an element, the element is to be construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

It will be understood that, although the terms "first", "second", etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings.

Figure 2:
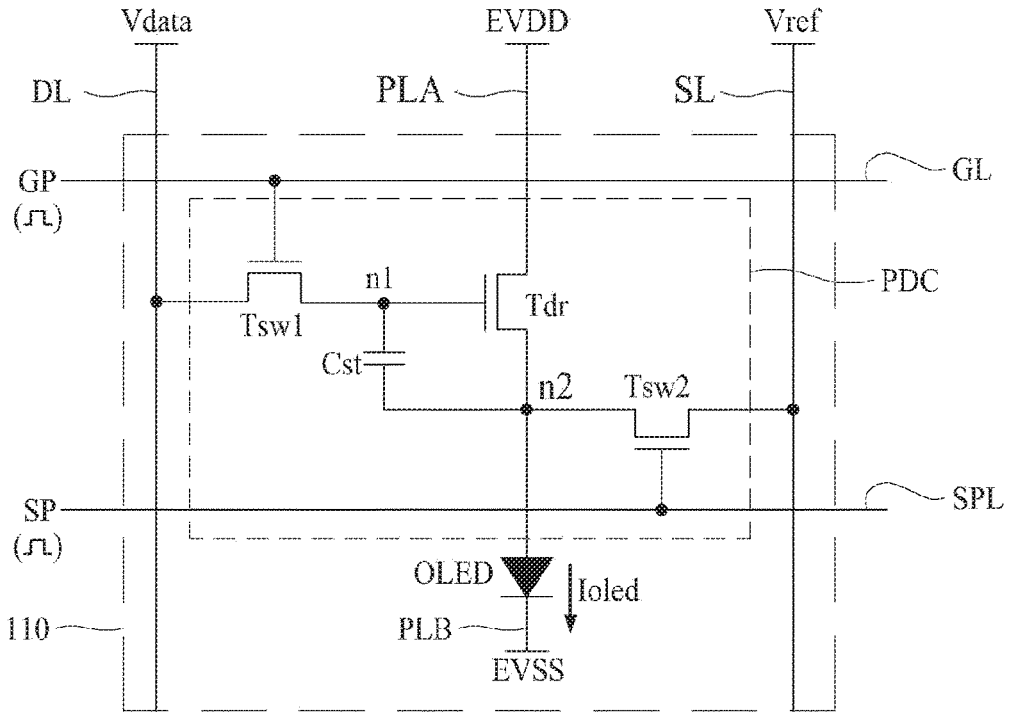
FIG. 2 is an exemplary diagram illustrating a configuration of one pixel of an organic light emitting display apparatus according to the present disclosure.
Figure 3:
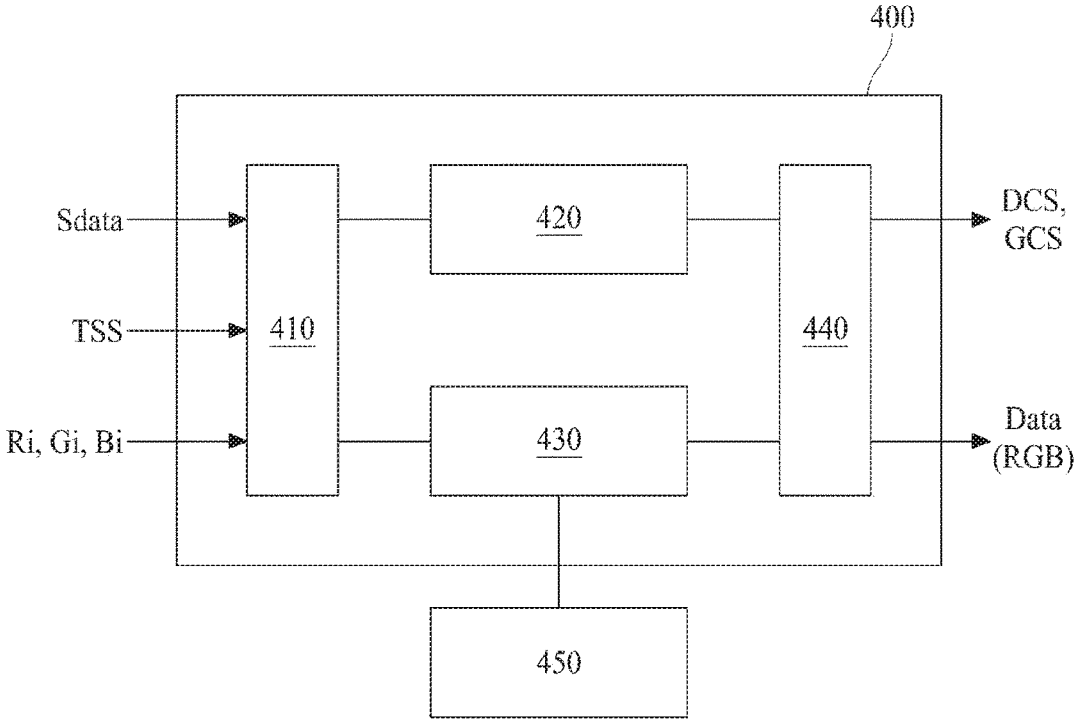
FIG. 3 is an exemplary diagram illustrating a configuration of a controller applied to an organic light emitting display apparatus according to the present disclosure.
Figure 4:
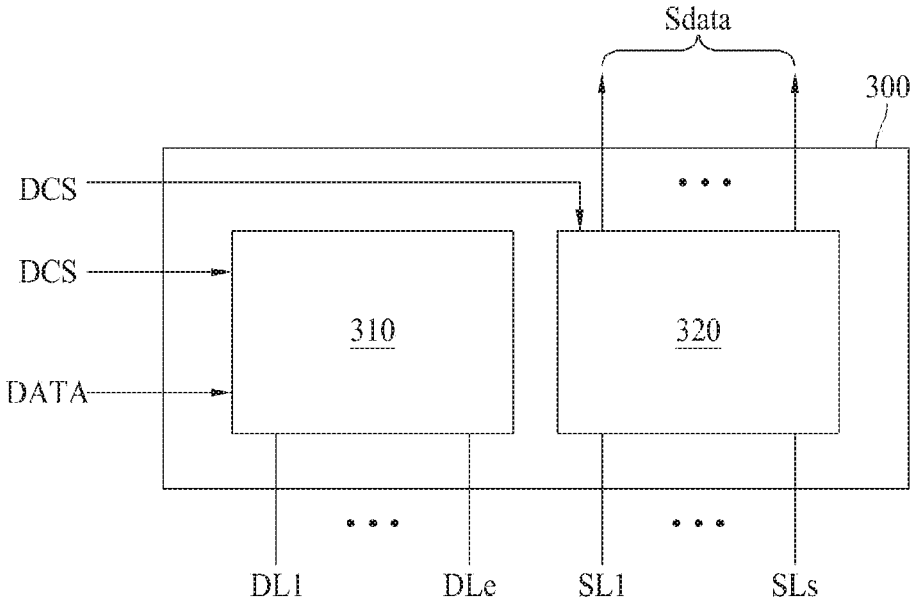
FIG. 4 is an exemplary diagram illustrating a configuration of a data driver applied to an organic light emitting display apparatus according to the present disclosure.

FIG. 1 is an exemplary diagram illustrating a configuration of an organic light emitting display apparatus according to the present disclosure. FIG. 2 is an exemplary diagram illustrating a configuration of one pixel of an organic light emitting display apparatus according to the present disclosure. FIG. 3 is an exemplary diagram illustrating a configuration of a controller applied to an organic light emitting display apparatus according to the present disclosure. FIG. 4 is an exemplary diagram illustrating a configuration of a data driver applied to an organic light emitting display apparatus according to the present disclosure.

The organic light emitting display apparatus according to the present disclosure, as illustrated in FIGS. 1 and 2, may include an organic light emitting display panel 100, a data driver, a gate driver 200, and a controller 400. The data driver may include at least one data driver integrated circuit (IC) 300.

In the description below, a vertical blank period may denote a period between one frame and another frame. A frame may denote one image. Therefore, the vertical blank period may denote a period between periods where two different images are output.

One frame period may denote a period where one image is displayed and may include one vertical blank period. That is, one frame period may include a period where one image is displayed and the vertical blank period where no image is displayed. Herein, when the order of frame periods is needed, the terms "a first frame period" and "a second frame period" may be used, and when the order of frame periods is not needed, the term "one frame period" may be used.

Herein, a first one frame period may be defined as a first frame period, and a second one frame period may be defined as a second frame period. That is, the first frame period and the second frame period may be periods which are successively executed.

Moreover, herein, a mode which displays an image and then displays a black image during one frame period may be referred to as a black image mode. The black image mode may be used to solve a problem where an image is not clearly seen due to the delay of a motion picture response time (MPRT). In the black image mode, for example, only an image desired by a user may be displayed during a first ½ period of one frame period, and during the other ½ period, a black image and an image may all be displayed.

Hereinafter, the elements may be sequentially described.

First, the organic light emitting display panel 100 may include a plurality of pixels which each include an organic light emitting diode OLED and a driving transistor for driving the organic light emitting diode OLED.

That is, as illustrated in FIG. 2, in the organic light emitting display panel 100, each of the plurality of pixels 110 may include the organic light emitting diode OLED and a pixel driving circuit PDC.

Moreover, in the organic light emitting display panel 100, a pixel area where each pixel 110 is provided may be defined, and a plurality of signal lines for providing a driving signal to the pixel driving circuit PDC may be provided.

The signal lines may include a gate line GL, a sensing pulse line SPL, a data line DL, a sensing line SL, a first driving power line PLA, and a second driving power line PLB.

A plurality of gate lines GL may be arranged in parallel at certain intervals in a first direction (for example, a widthwise direction) of the organic light emitting display panel 100.

A plurality of sensing pulse lines SPL may be arranged at certain intervals in parallel with the gate lines GL.

The data line DL may be provided in a second direction (for example, a lengthwise direction) of the organic light emitting display panel 100 to intersect (e.g., to overlap) the gate line GL and the sensing pulse line SPL, and the data line DL, the gate line GL, and the sensing pulse line SPL may be arranged in parallel at certain intervals. However, an arrangement structure of the data line DL and the gate line GL may be variously modified.

The sensing line SL may be spaced apart from the data line DL by a certain interval, and the sensing lines SL and the data lines DL may be arranged in parallel at certain intervals. However, the present disclosure is not limited thereto. For example, at least three pixels 110 may configure one unit pixel. In this case, one sensing line SL may be provided in the unit pixel. Therefore, when d (where d is an integer equal to or more than two) number of data lines DL1 to DLd in a horizontal line of the organic light emitting display panel 100, the number "k" of the sensing lines SL may be d/4. To provide an additional description, the data lines DL may be provided in the second direction (the lengthwise direction) of the organic light emitting display panel 100, the sensing lines SL may be provided in parallel with the data lines DL, and each of the sensing lines SL may be connected to at least three pixels 110 configuring each of unit pixels provided in one horizontal line.

The first driving power line PLA may be provided apart from the data line DL and the sensing line SL by a certain interval in parallel therewith. The first driving power line PLA may be connected to a power supply 500 and may transfer a first driving power EVDD, supplied from the power supply 500, to the pixel 110.

The second driving power line PBL may transfer a second driving power EVSS, supplied from the power supply 500, to the pixel 110.

The pixel driving circuit PDC may include a driving transistor Tdr which controls a current flowing in the organic light emitting diode OLED and a switching transistor Tsw1 connected between the data line DL, the driving transistor Tdr, and the gate line GL. Also, the pixel driving circuit PDC included in each of the pixels 110 may include a capacitor Cst, connected between a first node n1 and a second node n2, and a sensing transistor Tsw2 for external compensation.

The switching transistor Tsw1 may be turned on by a gate pulse GP and may transfer a data voltage Vdata, supplied through the data line DL, to a gate of the driving transistor Tdr.

The sensing transistor Tsw2 may be turned on by a sensing pulse SP and may transfer a sensing voltage, supplied through the sensing line SL, to the second node n2 which is a source electrode of the driving transistor Tdr.

As the switching transistor Tsw1 is turned on, the capacitor Cst may be charged with a voltage supplied to the first node n1, and then, the driving transistor Tdr may be turned on with a charged voltage.

The driving transistor Tdr may be turned on with a voltage of the capacitor Cst and may control the amount of data current Ioled flowing from the first driving power line PLA to the organic light emitting diode OLED.

The organic light emitting diode OLED may emit light with the data current Ioled supplied from the driving transistor Tdr, and for example, may emit the light having luminance corresponding to the data current Ioled.

Hereinabove, a structure of the pixel 110 including the sensing line SL for performing the external compensation has been described with reference to FIG. 2, but in addition to the structure illustrated in FIG. 2, the pixel 110 may be provided in various structures including the sensing line SL.

For example, the external compensation may denote an operation of calculating a variation amount of a threshold voltage or mobility (e.g., electron mobility) of the driving transistor Tdr provided in the pixel 110 and varying levels of data voltages supplied to the unit pixel on the basis of the variation amount. Therefore, in order to calculate the variation amount of the threshold voltage or mobility of the driving transistor Tdr, a structure of the pixel 110 may be changed to various structures. In this case, the sensing line SL should be provided.

Moreover, in order to perform the external compensation, a method of calculating the variation amount of the threshold voltage or mobility of the driving transistor Tdr by using the pixel 110 may be variously changed based on the structure of the pixel 110.

In this case, sensing for the external compensation may be performed on one gate line in one vertical blank period.

To provide an additional description, the present disclosure relates to an organic light emitting display apparatus which, when threshold voltages or mobility of driving transistors Tdr included in the organic light emitting display panel 100 are sensed, displays a black image along with the sensing during a vertical blank period, for the external compensation. Accordingly, the present disclosure does not directly relate to a particular external compensation method, but may instead be applicable to any of various external compensation techniques.

Therefore, a structure of each pixel for the external compensation may be implemented as various pixel structures proposed for the external compensation, and a method of performing the external compensation may be implemented as various external compensation methods.

That is, a detailed structure of each pixel for performing the external compensation and a detailed method for the external compensation are irrelevant to the scope of the present disclosure. Therefore, an example of a pixel for the external compensation has been simply described above with reference to FIG. 2, and an external compensation method will be simply described below. However, it will be readily appreciated that any of a variety of pixel structures and circuits, as well as any of a variety of external compensation methods, may be utilized in accordance with various embodiments of the present disclosure.

Moreover, as described above, the present disclosure may use the black image mode. The structure of the pixel 110 with the black image mode applied thereto may be variously changed based on the black image mode, in addition to the structure illustrated in FIG. 2.

That is, FIG. 2 illustrates the structure of the pixel 110 for performing the external compensation and the black image mode, and thus, the structure of the pixel 110 may be changed to various structures, in addition to the structure illustrated in FIG. 2.

Hereinafter, an organic light emitting display apparatus based on the external compensation will be described as an example of the present disclosure.

Second, the gate driver 200 may sequentially supply the gate pulse GP to a plurality of gate lines GL1 to GLg by using gate control signals GCS provided by or transferred from the controller 400.

Here, the gate pulse GP may denote a signal for turning on the switching transistor Tsw1 connected to the gate lines GL1 to GLg. A signal for turning off the switching transistor Tsw1 may be referred to as a gate-off signal. A generic name for the gate pulse GP and the gate-off signal may be a gate signal.

The gate driver 200 may be provided independently from the organic light emitting display panel 100 and may be connected to the organic light emitting display panel 100 through a tape carrier package (TCP), a chip-on film (COF), or a flexible printed circuit board (FPCB), but is not limited thereto, and/or may be directly equipped in the organic light emitting display panel 100 by using a gate-in panel (GIP) type.

The gate driver 200 may output image gate pulses, which control outputs of image data voltages for displaying an image, to the gate lines included in the organic light emitting display panel in a first period of a first frame period.

The gate driver 200 may output the image gate pulses and black gate pulses for controlling outputs of black image data voltages for displaying a black image in a second period arriving after (subsequent to) the first period.

The gate driver 200 may output a sensing gate pulse to one gate line connected to driving transistors, of which characteristic variation is to be sensed, in a third period after the second period of the first frame period until a first period of a second frame period starts.

The image gate pulses, the black gate pulses, and the sensing gate pulses may be the gate pulses for turning on the switching transistor Tsw1.

The black gate pulses may be output in a period from the second period of the first frame period to the first period of the second frame period.

The third period may correspond to the vertical blank period. A generic name for the first period and the second period may be a display period.

To this end, as illustrated in FIG. 1, the gate driver 200 may include a first driver 221 which generates the image gate pulses, the black gate pulses, and the sensing gate pulse by using a first set of gate clocks, e.g., first to eighth gate clocks provided by or transferred from the controller 400 in the first frame period, a second driver 222 which generates the image gate pulses, the black gate pulses, and the sensing gate pulse by using a second set of gate clocks, e.g., ninth to sixteenth gate clocks provided by or transferred from the controller 400 in the first frame period, and a third driver 210 which controls the first driver 221 and the second driver 222 to output the sensing gate pulse in the third period of the first frame period. In an exemplary embodiment the image gate pulses, the black gate pulses, and the sensing gate pulses may be identical.

The gate pulses may be output from the first driver 221 and the second driver 222. Therefore, the first driver 221 and the second driver 222 may be included in a gate pulse output circuit 220 (which may be referred to herein as a gate pulse output unit 220). The gate pulse output unit 220 may include any electrical circuitry, features, components or the like configured to perform the various operations of the gate pulse output unit 220 as described herein.

A detailed configuration and function of the gate driver 200 will be described below in detail with reference to FIG. 5.

Third, the controller 400 may control the gate driver 200 and the data driver IC 300.

The controller 400, as illustrated in FIG. 3, may generate a gate control signal GCS for controlling driving of the gate driver 200 and a data control signal DCS for controlling driving of the data driver IC 300 by using a timing synchronization signal TSS output from an external system.

Moreover, in a sensing mode where sensing for the external compensation is performed, the controller 400 may transfer pieces of sensing image data, which are to be supplied to pixels connected to a gate line on which the external compensation is performed, to the data driver IC 300. Sensing for the external compensation may be performed at various timings. For example, sensing for the external compensation relevant to mobility variations of the driving transistors Tdr may be performed in the vertical blank period.

The controller 400 may calculate external compensation values on the basis of pieces of sensing data Sdata which are provided from the data driver after the sensing is performed in the vertical blank period and may store the external compensation values in a storage unit 450. The storage unit 450 may be included in the controller 400, or may be independently implemented outside the controller 400.

In a display period where an image is displayed, the controller 400 may compensate for pieces of input video data Ri, Gi, and Bi transferred from the external system by using the external compensation values to generate pieces of external compensation image data, or may not perform the external compensation on the input video data and may realign the pieces of input video data to generate and output pieces of normal image data. The data driver IC 300 may convert the pieces of external compensation image data or the pieces of normal image data into the data voltages Vdata and may supply the data voltages Vdata to the data lines DL1 to DLd.

In order to perform the above-described function, as illustrated in FIG. 3, the controller 400 may include a data aligner which realigns the pieces of input video data Ri, Gi, and Bi transferred from the external system by using the timing synchronization signal TSS transferred from the external system and supplies pieces of realigned image data to the data driver IC 300, a control signal generator 420 which generates the gate control signal GCS and the data control signal DCS by using the timing synchronization signal TSS, a calculator 410 which calculates an external compensation value for compensating for a characteristic variation of the driving transistor Tdr provided in each of the pixels 110 by using the pieces of sensing data Sdata transferred from the data driver IC 300, the storage unit 450 which stores the external compensation value, and an output circuit 440 (which may be referred to herein as an output unit 440) which outputs, to the data driver IC 300 or the gate driver 200, pieces of image data Data generated by the data aligner 430 and the gate control signal GCS and the data control signal DCS each generated by the control signal generator 420. The storage circuit 450 (which may be referred to herein as a storage unit 450) may include the controller 400, and as illustrated in FIG. 3, may be implemented independently from the controller 400. The data aligner 430 may convert the pieces of input video data into the pieces of image data by using the external compensation value. The controller 400, calculator 410, control signal generator 420, data aligner 430, output unit 440, and storage unit 450 may include any electrical circuitry, features, components or the like configured to perform the various operations of the controller 400, calculator 410, control signal generator 420, data aligner 430, output unit 440, and storage unit 450 as described herein. In some embodiments, one or more of the controller 400, calculator 410, control signal generator 420, data aligner 430, output unit 440, and storage unit 450 may be included in or otherwise implemented by processing circuitry such as a microprocessor, microcontroller, integrated circuit or the like.

Particularly, the calculator 410 may set a gate line on which sensing is to be performed in one vertical blank period and may set a timing (hereinafter referred to as a sensing timing) at which the sensing is performed.

In this case, a timing at which the sensing is performed may be set differently for each gate line. However, all of the sensing timings may not differ in all of the gate lines. For example, at least two different sensing timings may be applied to the present disclosure.

The calculator 410 may control the control signal generator 420 so as to set a gate line on which the sensing is to be performed and may control the control signal generator 420 so as to set the sensing timing.

The control signal generator 420 may generate a line selection signal for setting a gate line on which the sensing is to be performed and may provide or transfer the generated line selection signal to the gate driver 200, based on control by the calculator 410. Also, the control signal generator 420 may generate a reset signal for setting the sensing timing and may provide or transfer the generated reset signal to the gate driver 200, based on control by the calculator 410.

The line selection signal and the reset signal may be included in the gate control signal GCS.

The control signal generator 420 may generate gate clocks used to generate the gate pulses and may transfer the generated gate clocks to the gate driver 200. The gate clocks may be included in the gate control signal GCS.

Fourth, the data driver may include at least one data driver IC 300. In FIG. 1, an organic light emitting display apparatus where two or more data driver ICs 300 are provided is illustrated as an example of the present disclosure.

The data driver IC 300 may be included in a COF 600 attached on the organic light emitting display panel 100. The COF 600 may be connected to a main board 700 including the controller 400. However, the data driver IC 300 may be directly equipped in the organic light emitting display panel 100.

Each of the data driver ICs 300 may be connected to corresponding data lines and sensing lines and may operate in a display mode, a black mode, and a sensing mode according to a control signal transferred from the controller 400.

The display mode may be a mode which displays an image and may be performed in the first period and the second period.

The black mode may be a mode which displays a black image and may be performed in the second period and the third period. Particularly, the black mode may be performed in a period from the second period of the first frame period to a portion of the first period of the second frame period, i.e., the black mode may be performed during a period including second and third periods of a frame period, and a part of a first period of a subsequent frame period.

The sensing mode may be a mode which senses mobility of the driving transistors and may be performed in the third period (i.e., the vertical blank period).

At least one data driver IC 300, as illustrated in FIG. 4, may include a data power supply unit 310 and a sensing unit 320. The data power supply unit 310 may be connected to the data lines DL, and the sensing unit 320 may be connected to the sensing lines SL.

The data power supply unit 310 may output the image data voltages to the data lines DL included in the organic light emitting display panel 100 in the first period, output the image data voltages or the black image data voltages in the second period, and output sensing image data voltages for outputting a sensing image or the black image data voltages in the third period.

For example, in the display mode (i.e., the first period and the second period), the data power supply unit 310 may convert the pieces of image data Data, supplied from the controller 400 by units of horizontal lines, into image data voltages and may supply the image data voltages to the data lines DL so as to display an image.

In the black mode (i.e., the second period, the third period, and a partial period of the first period arriving after (subsequent to) the third period), the data power supply unit 310 may convert the pieces of black image data, transferred from the controller 400, into black image data voltages and may supply the black image data voltages to the data lines connected to the data driver IC 300 so as to display a black image.

In the sensing mode (i.e., the third period), the data power supply unit 310 may convert the pieces of sensing image data, transferred from the controller 400, into sensing image data voltages and may supply the sensing image data voltages to the data lines connected to the data driver IC 300 so as to sense a variation amount of mobility of each of the driving transistors Tdr.

In the display mode, the sensing unit 320 may supply a voltage, needed for driving of the pixel driving circuit PDC, to the pixels 110 through the sensing lines SL.

In the black mode, the sensing unit 320 may supply a voltage, needed for driving of the pixel driving circuit PDC, to the pixels 110 through the sensing lines SL.

In the sensing mode, the sensing unit 320 may supply sensing voltages to sensing lines connected to the sensing unit 320, and then, may receive signals corresponding to the sensing voltages. The sensing unit 320 may convert the signals, representing variations of the mobility of the driving transistors Tdr included in the pixels 110 provided in one horizontal line, into the pieces of sensing data Sdata which are digital data. The sensing unit 320 may provide the pieces of sensing data Sdata to the controller 400. In this case, the controller 400 may calculate an external compensation value by using the pieces of sensing data Sdata.

Figure 5:
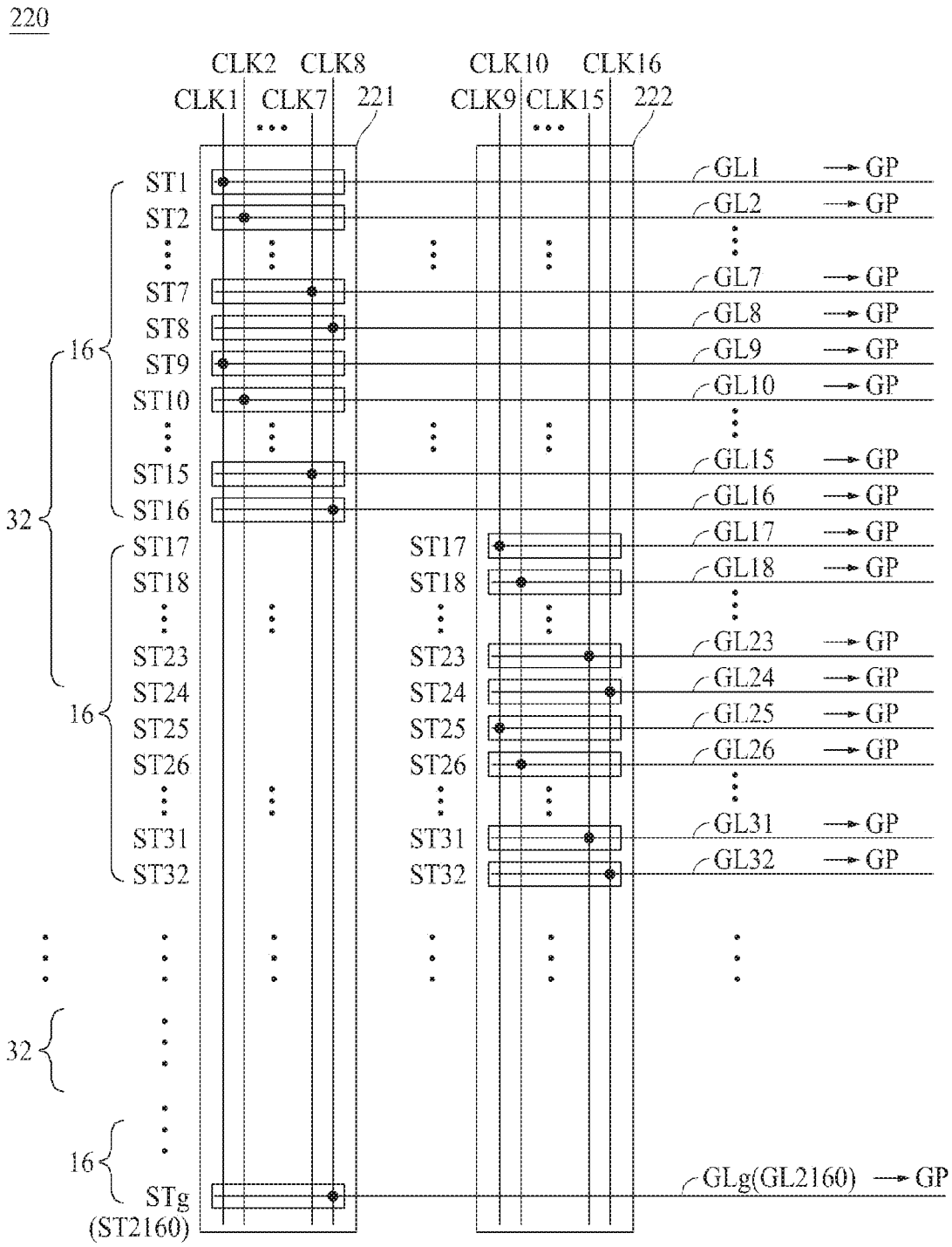
FIG. 5 is an exemplary diagram illustrating a configuration of a gate pulse output unit of a gate driver applied to an organic light emitting display apparatus according to the present disclosure.
Figure 6:
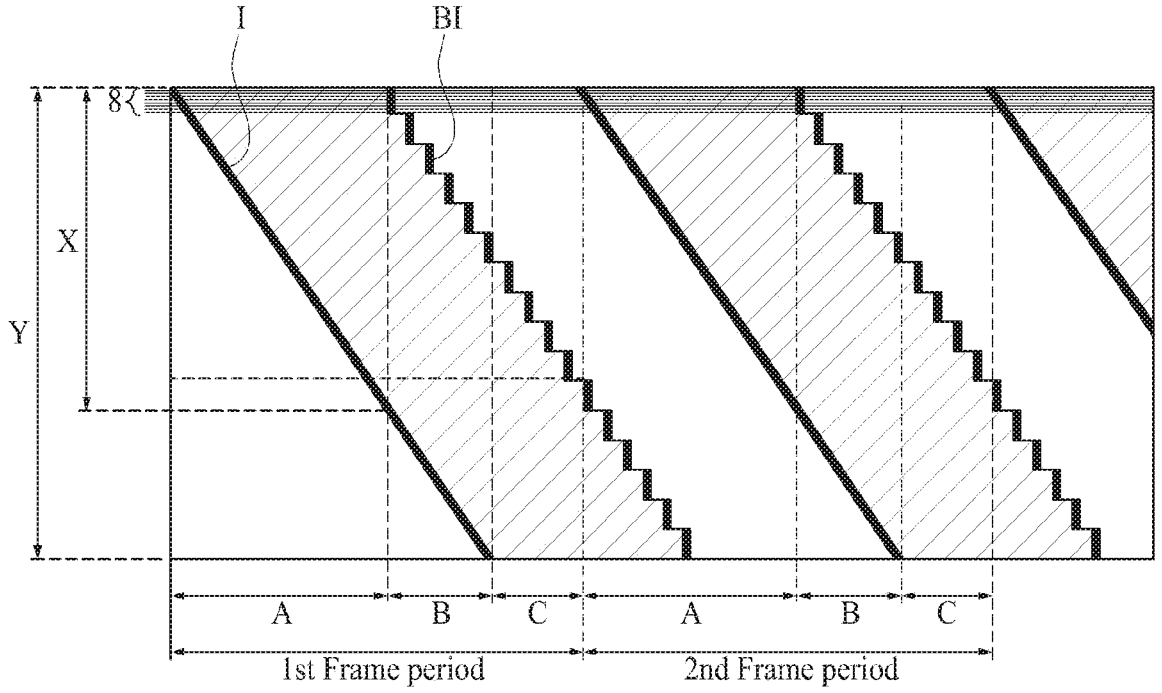
FIG. 6 is an exemplary diagram illustrating a driving period of an organic light emitting display apparatus according to the present disclosure.
Figure 7:
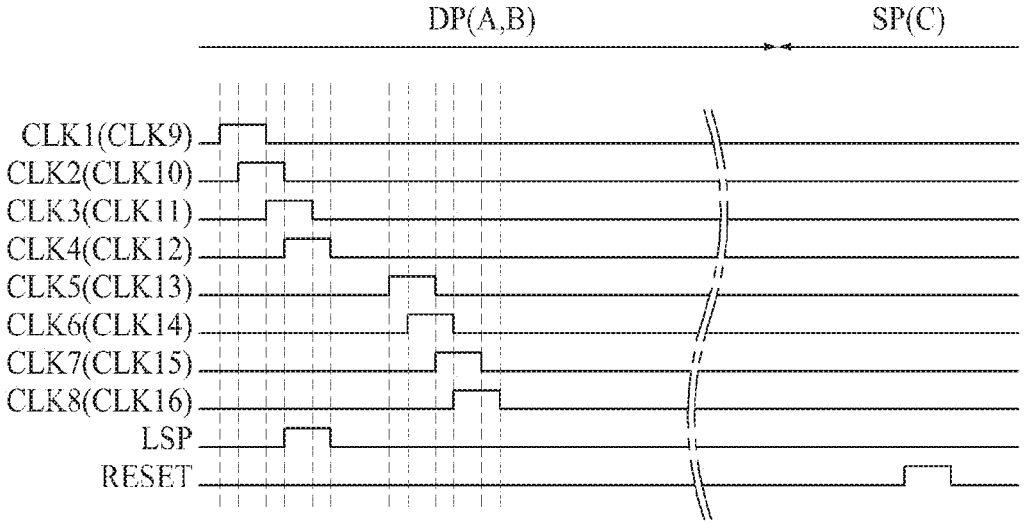
FIG. 7 is an exemplary diagram showing waveforms of clocks applied to an organic light emitting display apparatus according to the present disclosure.
Figure 8:
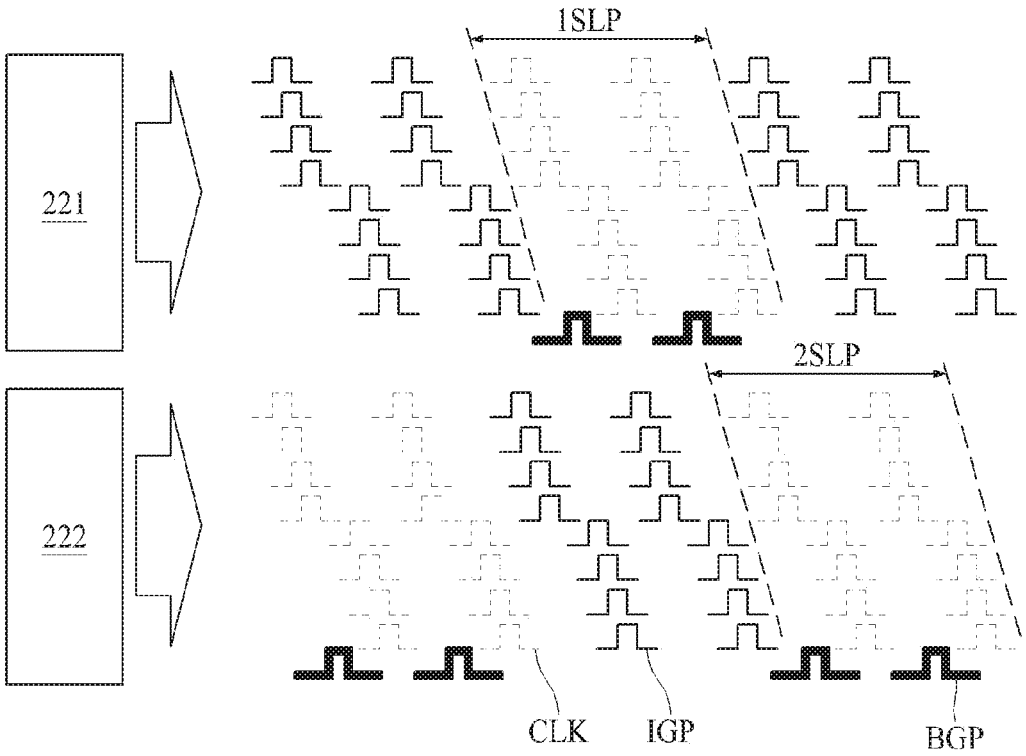
FIG. 8 is an exemplary diagram showing gate pulses output from a gate driver in a second period of an organic light emitting display apparatus according to the present disclosure.
Figure 9:
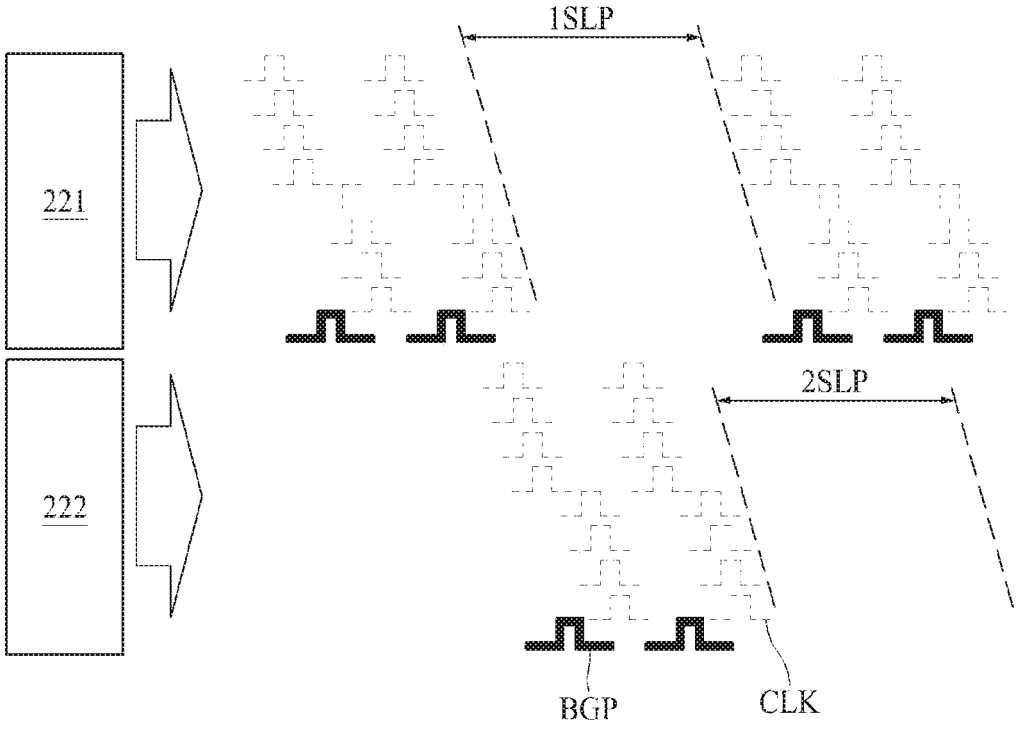
FIG. 9 is an exemplary diagram showing gate pulses output from a gate driver in a third period of an organic light emitting display apparatus according to the present disclosure.

FIG. 5 is an exemplary diagram illustrating a configuration of a gate pulse output unit of a gate driver applied to an organic light emitting display apparatus according to the present disclosure. FIG. 6 is an exemplary diagram illustrating a driving period of an organic light emitting display apparatus according to the present disclosure. FIG. 7 is an exemplary diagram showing waveforms of clocks applied to an organic light emitting display apparatus according to the present disclosure. FIG. 8 is an exemplary diagram showing gate pulses output from a gate driver in a second period of an organic light emitting display apparatus according to the present disclosure. FIG. 9 is an exemplary diagram showing gate pulses output from a gate driver in a third period of an organic light emitting display apparatus according to the present disclosure.

First, a configuration of the gate driver 200 will be described below.

As described above, the gate driver 200 may include the gate pulse output unit 220, including the first driver 221 and the second driver 222, and the third driver 210.

The gate pulse output unit 220 may be connected to the gate lines GL1 to GLg and may output the gate pulse GP to the gate lines GL1 to GLg.

The first driver 221 configuring the gate pulse output unit 220 may generate the image gate pulses, the black gate pulses, and the sensing gate pulse by using the first to eighth gate clocks CLK1 to CLK8 transferred from the controller 400 in the first frame period.

The second driver 222 configuring the gate pulse output unit 220 may generate the image gate pulses, the black gate pulses, and the sensing gate pulse by using the ninth to sixteenth gate clocks CLK9 to CLK16 transferred from the controller 400 in the first frame period.

The third driver 210 may control the first driver 221 and the second driver 222 to output the sensing gate pulse in the third period of the first frame period.

That is, the third driver 210 may select a sensing gate line, to which the sensing gate pulse is to be output, from among the gate lines according to the line selection signal LSP transferred from the controller 400.

Moreover, the third driver 210 may control the first driver 221 or the second driver 222 according to a reset signal RESET transferred from the controller 400 in order for the first driver 221 or the second driver 222 to output the sensing gate pulse to the sensing gate line.

The line selection signal LSP, as illustrated in FIGS. 6 and 7, may be transferred from the controller 400 to the gate driver 200 along with one of the gate clocks which are used in a display period DP including a first period A and a second period B.

The reset signal RESET, as illustrated in FIGS. 6 and 7, may be transferred from the controller 400 to the gate driver 200 in a sensing period SP corresponding to a third period C.

Hereinafter, a basic operation of outputting, by the organic light emitting display apparatus according to the present disclosure, gate pulses GP will be described with reference to FIG. 5. Particularly, the below-described gate pulses GP may be gate pulses used to display an image.

For example, as shown in FIG. 5, a gate pulse GP generated from a first gate clock CLK1 by a first stage ST1 may be output to a first gate line GL1, a gate pulse GP generated from a second gate clock CLK2 by a second stage ST2 may be output to a second gate line GL2, gate pulses GP generated from third to sixth gate clocks CLK3 to CLK6 by third to sixth stages ST3 to ST6 may be respectively output to third to sixth gate line GL3 to GL6, a gate pulse GP generated from a seventh gate clock CLK7 by a seventh stage ST7 may be output to a seventh gate line GL7, and a gate pulse GP generated from an eighth gate clock CLK8 by an eighth stage ST8 may be output to an eighth gate line GL8.

A gate pulse GP generated from the first gate clock CLK1 by a ninth stage ST9 may be output to a ninth gate line GL9, a gate pulse GP generated from the second gate clock CLK2 by a tenth stage ST10 may be output to a tenth gate line GL10, gate pulses GP generated from the third to sixth gate clocks CLK3 to CLK6 by eleventh to fourteenth stages ST11 to ST14 may be respectively output to eleventh to fourteenth gate line GL11 to GL14, a gate pulse GP generated from the seventh gate clock CLK7 by a fifteenth stage ST15 may be output to a fifteenth gate line GL15, and a gate pulse GP generated from the eighth gate clock CLK8 by a sixteenth stage ST16 may be output to a sixteenth gate line GL16.

A gate pulse GP generated from a ninth gate clock CLK9 by a seventeenth stage ST17 may be output to a seventeenth gate line GL17, a gate pulse GP generated from a tenth gate clock CLK10 by an eighteenth stage ST18 may be output to an eighteenth gate line GL18, gate pulses GP generated from eleventh to fourteenth gate clocks CLK11 to CLK14 by nineteenth to twenty-second stages ST19 to ST22 may be respectively output to nineteenth to twenty-second gate line GL19 to GL22, a gate pulse GP generated from a fifteenth gate clock CLK15 by a twenty-third stage ST23 may be output to a twenty-third gate line GL23, and a gate pulse GP generated from a sixteenth gate clock CLK16 by a twenty-fourth stage ST24 may be output to a twenty-fourth gate line GL24.

A gate pulse GP generated from the ninth gate clock CLK9 by a twenty-fifth stage ST25 may be output to a twenty-fifth gate line GL25, a gate pulse GP generated from the tenth gate clock CLK10 by a twenty-sixth stage ST26 may be output to a twenty-sixth gate line GL26, gate pulses GP generated from the eleventh to fourteenth gate clocks CLK11 to CLK14 by twenty-seventh to thirtieth stages ST27 to ST30 may be respectively output to twenty-seventh to thirtieth gate line GL27 to GL30, a gate pulse GP generated from the fifteenth gate clock CLK15 by a thirty-first stage ST31 may be output to a thirty-first gate line GL31, and a gate pulse GP generated from the sixteenth gate clock CLK16 by a thirty-second stage ST32 may be output to a thirty-second gate line GL32.

Each of the stages may generate the image gate pulse, the black gate pulse, and the sensing gate pulse by using the gate control signal.

That is, as shown in FIG. 5, the gate pulses GP output to the first to sixteenth gate lines GL1 to GL16 may be generated from the first to eighth gate clocks CLK1 to CLK8 by the first driver 221, and the gate pulses GP output to the seventeenth to thirty-second gate lines GL17 to GL32 may be generated from the ninth to sixteenth gate clocks CLK9 to CLK16 by the second driver 222.

Therefore, a driver for outputting the gate pulses may be changed by units of sixteen gate pulses. Hereinafter, such a feature may be expressed as 16 periods.

Moreover, the same functions may be repeated at a period corresponding to 32 gate pulses. Hereinafter, such a feature may be expressed as 32 periods.

Therefore, for example, when the number of gate lines is 2,160, a period where 2,160 gate pulses are output may be expressed as 32n+16(Y). Here, n may be a natural number equal to or less than 67. For example, when the number of gate lines is 2,160, 32 periods may be repeated 67 times, and when 16 periods are performed once, the gate pulses may be output to all of the 2,160 gate lines.

That is, the display period including the first period A and the second period B of one frame period may be expressed as 32n+16(Y), and in the display period A and B, the image gate pulses for displaying an image I may be output to the gate lines on the basis of the above-described method.

In this case, after the gate pulses are output from the first driver 221, the first driver 221 may not output the gate pulses during 16 periods, and when the 16 periods elapse, the first driver 221 may again output the gate pulses.

Moreover, after the gate pulses are output from the second driver 222, the second driver 222 may not output the gate pulses during 16 periods, and when the 16 periods elapse, the second driver 222 may again output the gate pulses.

The one frame period (i.e., a period corresponding to a sum of the first period A, the second period B, and the third period C) may be set to 32m periods. Here, m may be a natural number more than n.

However, the above-described periods (i.e., 16 periods, 32 periods, 32n+16 periods, and 32m periods) are merely an example for describing the present disclosure, and the present disclosure is not limited thereto. That is, the periods may be variously changed.

Hereinafter, a method of outputting, by the organic light emitting display apparatus according to the present disclosure, image gate pulses IGP and black gate pulses BGP in the second period B will be described with reference to FIGS. 5 to 8.

As described above, the first driver 221 and the second driver 222 may repeatedly output the image gate pulses at every 16 periods.

In this case, as shown in FIG. 8, an interval between a fourth image gate pulse and a fifth image gate pulse of first to eighth image gate pulses IGP output from the first driver 221 may be set to be greater than an interval between other consecutive image gate pulses. To this end, as shown in FIG. 7, an interval between a fourth gate clock CLK4 and a fifth gate clock CLK5 of first to eighth gate clocks CLK1 to CLK8 used by the first driver 221 may be set to be greater than an interval between other gate clocks.

Moreover, as shown in FIG. 8, an interval between a twentieth image gate pulse and a twenty-first image gate pulse of seventeenth to twenty-fourth image gate pulses IGP output from the second driver 222 may be set to be greater than an interval between other consecutive image gate pulses. To this end, as shown in FIG. 7, an interval between a twelfth gate clock CLK12 and a thirteenth gate clock CLK13 of ninth to sixteenth gate clocks CLK9 to CLK16 used by the first driver 221 may be set to be greater than an interval between other gate clocks.

In the present disclosure, the black gate pulse BGP for displaying the black image may be output during a period corresponding to the interval between the fourth image gate pulse and the fifth image gate pulse. The black gate pulse BGP may be generated by a combination of the gate clocks, or may be generated by other gate clocks.

In this case, the black gate pulse BGP may be simultaneously output to eight gate lines. Therefore, switching transistors respectively connected to the eight gate lines may be simultaneously turned on, and thus, black image data voltages may be simultaneously supplied to data lines respectively connected to the switching transistors.

Therefore, as shown in FIG. 6, pixels corresponding to the eight gate lines may simultaneously display a black image BI.

The second driver 222 may simultaneously output the black gate pulses BGP to the eight gate lines. Therefore, pixels corresponding to the eight gate lines connected to the second driver 222 may simultaneously display a black image.

In this case, as shown in FIG. 8, the black gate pulse BGP may be output to the gate lines in a first sleeping period 1SLP where the first driver 221 does not output the image gate pulses IGP and a second sleeping period 2SLP where the second driver 222 does not output the image gate pulses IGP.

For example, FIG. 8 shows the second period B of the display period. In the second period B, image data voltages and black image data voltages may be output to the organic light emitting display panel 100, and to this end, as shown in FIG. 8, the image gate pulses IGP and the black gate pulses BGP may be output to the gate lines. The second period B, as shown in FIG. 6, may start from a time when 32k+16(X) periods elapse. Here, k may be a natural number less than n.

In the second period B, for example, as shown in FIG. 8, the first driver 221 may sequentially output the image gate pulses IGP to the gate lines during first 16 periods, the second driver 222 may sequentially output the image gate pulses IGP to the gate lines during second 16 periods, the first driver 221 may sequentially output the image gate pulses IGP to the gate lines during third 16 periods, and the second driver 222 may sequentially output the image gate pulses IGP to the gate lines during fourth 16 periods.

In this case, a period until the first driver 221 outputs the image gate pulses IGP again after outputting the image gate pulses IGP may be referred to as a first sleeping period 1SLP, and a period until the second driver 222 outputs the image gate pulses IGP again after outputting the image gate pulses IGP may be referred to as a second sleeping period 2SLP.

In the present disclosure, the black gate pulses BGP may be output in the first sleeping period 1SLP and the second sleeping period 2SLP of the second period B. That is, the black gate pulses BGP may be output in the first sleeping period 1SLP and the second sleeping period 2SLP of the second period B.

To provide an additional description, in the first period A of the display period DP, only the image gate pulse IGP shown in FIG. 8 may be output to the gate lines, and thus, the image I may be displayed by the organic light emitting display panel 100.

In the second period B of the display period DP, as shown in FIG. 8, after the image gate pulses IGP are output from the first driver 221, the black gate pulses may be output from the first driver 221 in the first sleeping period 1SLP, and after the image gate pulses IGP are output from the second driver 222, the black gate pulses may be output from the second driver 222 in the second sleeping period 2SLP, whereby the organic light emitting display panel 100 may display black images BI in a type illustrated in FIG. 6.

Finally, a method of outputting, by the organic light emitting display apparatus according to the present disclosure, black gate pulses BGP and sensing gate pulses in the third period C will be described with reference to FIGS. 5 to 9.

As described above, the black gate pulses BGP may be output in the first sleeping period 1SLP and the second sleeping period 2SLP of the second period B, and the image gate pulses IGP may be output in periods other than the first sleeping period 1SLP and the second sleeping period 2SLP of the second period B.

In this case, the sensing gate pulses may be output in the first sleeping period 1SLP and the second sleeping period 2SLP of the third period C, and the black gate pulses BGP may be output in periods other than the first sleeping period 1SLP and the second sleeping period 2SLP of the third period C.

In the third period C, for example, as shown in FIG. 9, the first driver 221 may sequentially output the black gate pulses BGP to the gate lines during first 16 periods, the second driver 222 may sequentially output the black gate pulses BGP to the gate lines during second 16 periods, the first driver 221 may sequentially output the black gate pulses BGP to the gate lines during third 16 periods, and the second driver 222 may sequentially output the black gate pulses BGP to the gate lines during fourth 16 periods.

In this case, a period until the first driver 221 outputs the black gate pulses BGP again after outputting the black gate pulses BGP may be referred to as a first sleeping period 1SLP, and a period until the second driver 222 outputs the black gate pulses BGP again after outputting the black gate pulses BGP may be referred to as a second sleeping period 2SLP.

In the present disclosure, the sensing gate pulses may be output in the first sleeping period 1SLP and the second sleeping period 2SLP of the third period C.

To provide an additional description, in the present disclosure, the first driver 221 and the second driver 222 may be driven at 16 periods, and thus, there may be periods (i.e., the first sleeping period 1SLP and the second sleeping period 2SLP) where the first driver 221 is not driven.

In this case, only the image gate pulses IGP may be output in the first period A, and thus, specific signals may not be output in the first sleeping period 1SLP and the second sleeping period 2SLP.

In the second period B, the black gate pulses BGP as well as the image gate pulses IGP may be output. Therefore, in the present disclosure, the black gate pulses BGP may be output in the first sleeping period 1SLP and the second sleeping period 2SLP of the second period B, and in the other periods, the image gate pulses IGP may be output.

In the third period C, the image gate pulses IGP may not be output, and the black gate pulses BGP and the sensing gate pulses may be output. Therefore, in the present disclosure, the sensing gate pulses may be output in the first sleeping period 1SLP and the second sleeping period 2SLP of the third period C, and in the other periods, the black gate pulses BGP may be output.

Here, all periods of the first sleeping period 1SLP and all periods of the second sleeping period 2SLP may not be used as a period (i.e., a sensing-enabled period) where the sensing gate pulses are output.

That is, a period capable of being used as the sensing-enabled period in the first sleeping period 1SLP and the second sleeping period 2SLP is not limited, and a timing of the sensing-enabled period may be set differently for each gate line.

For example, a period until the sensing gate pulse is output to a sensing gate line after the black gate pulse BGP is output in the third period C of the first frame period may differ from a period until the sensing gate pulse is output to another sensing gate line after the black gate pulse BGP is output in the third period C of the second frame period. This will be described below in detail with reference to FIG. 10.

The structure and configuration of the gate driver 200 described above with reference to FIGS. 5 to 9 have been described above as an example of the present disclosure, and thus, the present disclosure is not limited thereto. That is, the structure and configuration of the gate driver 200 may be changed to various types for performing the above-described function.

Figure 10:
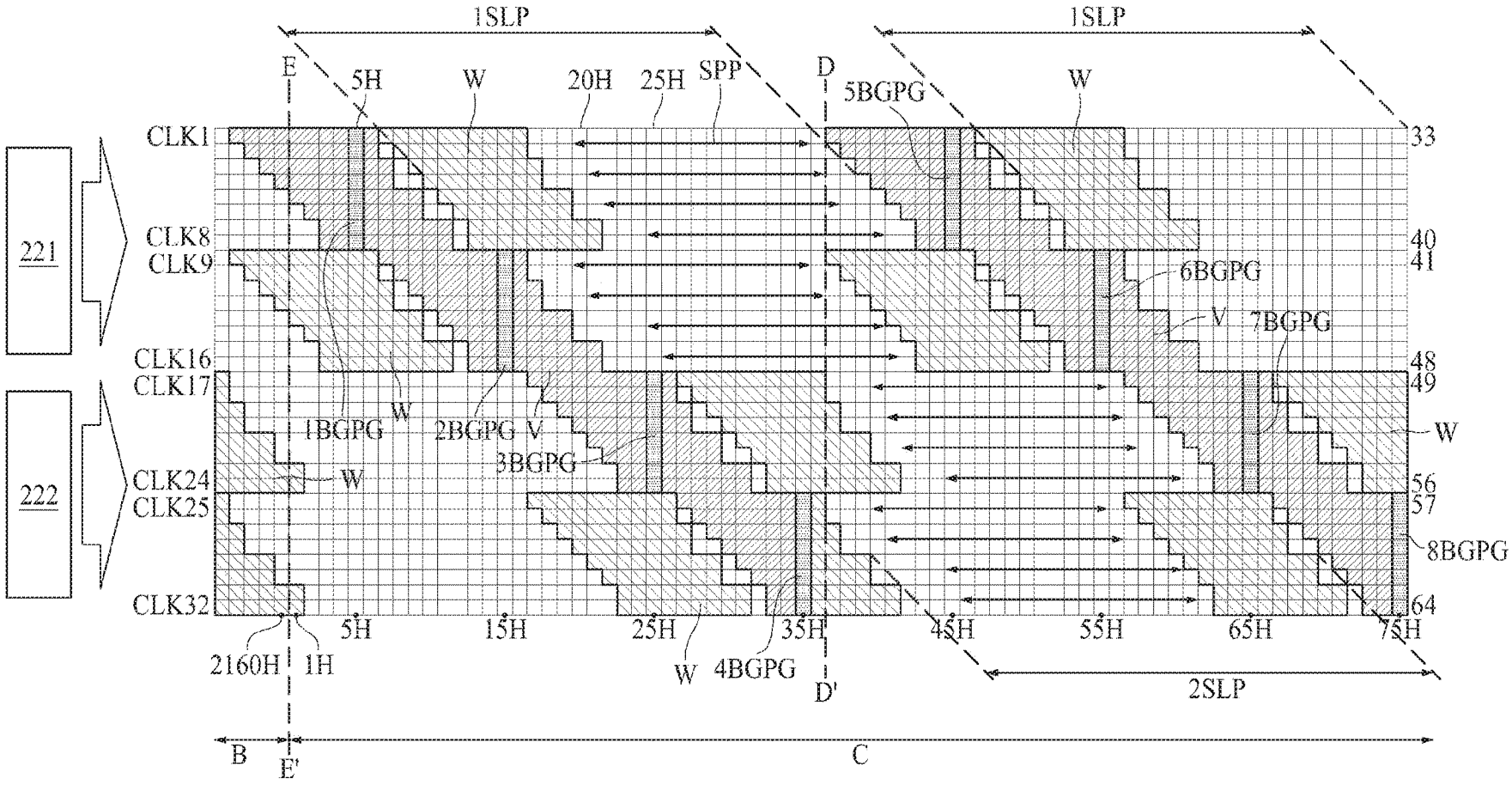
FIG. 10 is an exemplary diagram showing a third period of an organic light emitting display apparatus according to the present disclosure.

FIG. 10 is an exemplary diagram showing a third period of an organic light emitting display apparatus according to the present disclosure, and particularly, is an exemplary diagram showing different sensing-enabled periods in a sleeping period. Hereinafter, a driving method of the organic light emitting display apparatus according to the present disclosure will be described with reference to FIGS. 1 to 10. In the following description, description which is the same as or similar to the above description is omitted or will be simply given.

First, in the first period A of the first frame period, the gate driver 200 may output image gate pulses, which control outputs of image data voltages for displaying the image I, to the gate lines included in the organic light emitting display panel 100.

In this case, the first driver 221 may generate image gate pulses IGP by using the first to eighth gate clocks transferred from the controller 400 and may output the generated image gate pulses IGP to sixteen gate lines.

The second driver 222 may generate image gate pulses IGP by using the ninth to sixteenth gate clocks transferred from the controller 400 and may output the generated image gate pulses IGP to sixteen other gate lines.

The third driver 210 may select a sensing gate line, to which the sensing gate pulse is to be output in the third period C, from among the gate lines according to the line selection signal LSP transferred from the controller 400.

The controller 400 may convert pieces of input video data into pieces of image data and may transfer the pieces of image data to the data driver IC 300.

Particularly, the controller 400 may output the line selection signal LSP to the third driver 210 at a timing at which a gate clock corresponding to an image gate pulse output to the sensing gate line in the first period A of the first frame period among the gate clocks CLK1 to CLK16 is output to the first driver 221 or the second driver 222.

The third driver 210 may store the line selection signal LSP received in the first period A. The line selection signal LSP may include information about a sensing gate line on which sensing is performed in the third period C.

The data driver IC 300 may convert the pieces of image data, transferred from the controller 400, into the image data voltages.

The data driver IC 300 may output the image data voltages to the data lines in a period where the image gate pulse IGP is supplied to the gate line.

Therefore, as shown in FIG. 6, the image I may be displayed by the organic light emitting display panel 100 in the period A.

Subsequently, in the second period B of the first frame period, the gate driver 200 may output, to the gate lines included in the organic light emitting display panel 100, image gate pulses IGP for controlling outputs of image data voltages used to output an image I and black gate pulses BGP for controlling outputs of black image data voltages used to output a black image I.

That is, the gate driver 200 may output the image gate pulses IGP and the black gate pulses BGP to the gate lines by using a method described above with reference to FIG. 8.

A function of outputting, by the controller 400, the line selection signal LSP to the third driver 210 may be performed in the second period B as well as the first period A.

For example, when an image gate pulse output to a sensing gate line on which sensing is to be performed in the third period C is output to the sensing gate line in the second period B, the controller 400 may output the line selection signal LSP to the third driver 210 at a timing at which a gate clock corresponding to an image gate pulse among the gate clocks CLK1 to CLK16 is output to the first driver 221 or the second driver 222 in the second period B.

The third driver 210 may store the line selection signal LSP received in the second period B. The line selection signal LSP may include information about a sensing gate line on which sensing is performed in the third period C.

In the first frame period, the line selection signal LSP may be transferred to the third driver 210 only once.

That is, since sensing is performed on one sensing gate line in the third period C, the line selection signal LSP may be transferred to the third driver 210 in the first frame period only once.

In the second period B, the controller 400 may generate pieces of image data corresponding to the image I and pieces of black image data corresponding to the black image BI and may transfer the generated image data and black image data to the data driver IC 300.

The pieces of black image data may be stored in the storage unit 450, and then, may be transferred to the data driver IC 300.

The data driver IC 300 may convert the pieces of image data into image data voltages and may convert the pieces of black image data into black image data voltages.

The data driver IC 300 may output the image data voltages to the data lines in a period where the image gate pulse IGP is supplied to the gate line and may output the black image data voltages to the data lines in a period where the black gate pulse BGP is supplied to the gate line.

Therefore, in the second period B, as shown in FIG. 6, the image I and the black image BI may be displayed by the organic light emitting display panel 100.

Finally, in the third period C after the second period B of the first frame period until the first period A of the second frame starts, the gate driver 200 may output the black gate pulses BGP, which control outputs of the black image data voltages used to display the black image BI, to the gate lines included in the organic light emitting display panel 100.

Moreover, in the first sleeping period 1SLP or the second sleeping period 2SLP, the gate driver 200 may output a sensing gate pulse to one gate line (i.e., a sensing gate line) connected to driving transistors on which characteristic variation is to be sensed (i.e., sensing is to be performed).

The third driver 210 may control the first driver 221 or the second driver 222 in the third period C in order for the sensing gate pulse to be output.

Particularly, the third driver 310 may control the first driver 221 or the second driver 222 according to a reset signal RESET transferred from the controller 400 so that the first driver 221 or the second driver 222 outputs the sensing gate pulse to the sensing gate line.

When the sensing gate pulse is output from the first driver 221, the controller 400 may select, as a sensing-enabled period SPP, one period of a first sleeping period 1SLP until the second driver 222 outputs black gate pulses after the first driver 221 is driven for outputting the black gate pulses and the first driver 221 is again driven for outputting the black gate pulses, in the third period C, and may transfer the reset signal RESET, indicating the start of the sensing-enabled period SPP, to the third driver 210.

The third driver 210 may control the first driver 221 or the second driver 222 according to the reset signal RESET transferred from the controller 400. That is, the third driver 210 may store information about a sensing gate line on which the sensing is to be performed, based on the line selection signal LSP transferred in the first period A or the second period B. In the third period C, when the reset signal RESET is received, the third driver 210 may transfer the reset signal RESET to one, connected to the sensing gate line, of the first driver 221 and the second driver 222.

The reset signal RESET may be supplied to a stage which outputs a sensing gate pulse to the sensing gate line. The stage which has received the reset signal RESET may output the sensing gate pulse to the sensing gate line at a start timing of the sensing-enabled period SPP.

When the sensing gate pulse is output from the second driver 222, the controller 400 may select, as a sensing-enabled period SPP, one period of a second sleeping period 2SLP until the first driver 221 outputs black gate pulses after the second driver 222 is driven for outputting the black gate pulses and the second driver 222 is again driven for outputting the black gate pulses, in the third period C, and may transfer the reset signal RESET, indicating the start of the sensing-enabled period SPP, to the third driver 210.

The third driver 210 may control the first driver 221 or the second driver 222 according to the reset signal RESET transferred from the controller 400. That is, the third driver 210 may store information about a sensing gate line on which the sensing is to be performed, based on the line selection signal LSP transferred in the first period A or the second period B. In the third period C, when the reset signal RESET is received, the third driver 210 may transfer the reset signal RESET to one, connected to the sensing gate line, of the first driver 221 and the second driver 222.

The reset signal RESET may be supplied to a stage which outputs a sensing gate pulse to the sensing gate line. The stage which has received the reset signal RESET may output the sensing gate pulse to the sensing gate line at a start timing of the sensing-enabled period SPP.

In the third period C, the controller 400 may generate pieces of black image data corresponding to the black image BI and pieces of sensing image data corresponding to the sensing image and may transfer the generated black image data and sensing image data to the data driver IC 300.

The data driver IC 300 may convert the pieces of black image data into black image data voltages and may convert the pieces of sensing image data into sensing image data voltages.

The data driver IC 300 may output the black image data voltages to the data lines in a period where the black gate pulse BGP is supplied to the gate line and may output the sensing image data voltages to the data lines in a period where the sensing gate pulse is supplied to the gate line.

Therefore, in the third period C, the organic light emitting display panel 100 may display the black image BI and the sensing image. In this case, variation amounts of mobility of driving transistors Tdr included in pixels connected to the sensing gate lines may be sensed based on the sensing image data voltages. External compensation values may be calculated based on the variation amounts of mobility and may be used in a second frame or frames subsequent thereto.

As described above, a period until the sensing gate pulse is output to a sensing gate line after the black gate pulse BGP is output in the third period C of the first frame period may differ from a period until the sensing gate pulse is output to another sensing gate line after the black gate pulse BGP is output in the third period C of the second frame period.

For example, in FIG. 10, with respect to line E-E', a left portion represents the second period B, and a right portion represents the third period C.

Moreover, in FIG. 10, the ordinate axis denotes the gate clocks or the gate lines. Also, in FIG. 10, with respect to line D-D', a left portion represents black gate pulses which are output according to initial driving of the first driver 221 and the second driver 222, and a right portion represents black gate pulses which are output according to second driving of the first driver 221 and the second driver 222.

For example, as illustrated in the left ordinate axis and a left portion with respect to line D-D' in FIG. 10, black gate pulses may be output to first to sixteenth gate lines according to first to eighth gate clocks CLK1 to CLK8 used in the first driver 221, and black gate pulses may be output to seventeenth to thirty-second gate lines according to ninth to sixteenth gate clocks CLK9 to CLK16 used in the second driver 222.

After the black gate pulses are output to the sixteenth gate line, as illustrated in a right portion with respect to line D-D', black gate pulses may be output to thirty-third to forty-eighth gate lines according to the first to eighth gate clocks CLK1 to CLK8 used in the first driver 221, and black gate pulses may be output to forty-ninth to sixty-fourth gate lines according to the ninth to sixteenth gate clocks CLK9 to CLK16 used in the second driver 222.

Moreover, in FIG. 10, the abscissa axis represents time. In FIG. 10, one tetragon is represented by a number, and the number may denote time or may denote a gate line. For convenience of description, in FIG. 10, the number is illustrated along with H. Here, H may denote time. In other words, the time is given in units of H.

As described above, the first driver 221 or the second driver 222 may simultaneously output the black gate pulses BGP to eight gate lines. Therefore, in FIG. 10, eight black gate pulses simultaneously output to eight gate lines are represented as a group.

For example, black gate pulses output at 5H of the abscissa axis in FIG. 10 are illustrated as a first black gate pulse group 1BGPG, black gate pulses output at 15H are illustrated as a second black gate pulse group 2BGPG, black gate pulses output at 25H are illustrated as a third black gate pulse group 3BGPG, and black gate pulses output at 35H are illustrated as a fourth black gate pulse group 4BGPG.

Moreover, in FIG. 10, each of regions illustrated by V represents a region which is driven for outputting a black gate pulse to a gate line connected to each of stages of the first driver 221 or the second driver 222, and each of regions illustrated by W represents a region which is driven for generating signals needed for a previous stage or a next stage with respect to each of stages of the first driver 221 or the second driver 222.

That is, in FIG. 10, a region illustrated by V and W represents a period where the first driver 221 and the second driver 222 are driven, and a region which is not illustrated by V and W represents a period where the first driver 221 and the second driver 222 are not driven.

As described above, a first sleeping period 1SLP may denote a period until the second driver 222 outputs black gate pulses after the first driver 221 is driven for outputting the black gate pulses BGP and the first driver 221 is again driven for outputting the black gate pulses, in the third period C.

A second sleeping period 2SLP may denote a period until the first driver 221 outputs black gate pulses after the second driver 222 is driven for outputting the black gate pulses BGP and the second driver 222 is again driven for outputting the black gate pulses, in the third period C.

In this case, as shown in FIG. 10, there may be regions illustrated by W in the first sleeping period 1SLP and the second sleeping period 2SLP.

As described above, the region illustrated by W may denote a region where the first driver 221 and the second driver 222 are driven for outputting black gate pulses BGP.

A sensing gate pulse may not be output while the first driver 221 and the second driver 222 are being driven for outputting the black gate pulses.

Therefore, in the present disclosure, the controller 400 may select, as a sensing-enabled period SPP, one period from among the first sleeping period 1SLP and the second sleeping period 2SLP and may transfer the reset signal RESET, indicating the start of the sensing-enabled period SPP, to the third driver 210. Also, the third driver 210 may control the first driver 221 or the second driver 222 according to the reset signal RESET, and the first driver 221 or the second driver 222 may output the sensing gate pulse to the gate line at a timing corresponding to the reset signal RESET.

For example, in FIG. 10, a sensing gate pulse may be output to first and second gate lines at a timing 20H, a sensing gate pulse may be output to third and fourth gate lines at a timing 21H, a sensing gate pulse may be output to fifth and sixth gate lines at a timing 22H, and a sensing gate pulse may be output to seventh and eighth gate lines at a timing 25H.

In this case, it may be seen that a timing, at which the sensing gate pulse is output after a black gate pulse is output from a corresponding gate line, is set differently for each gate line.

That is, a period until the sensing gate pulse is output to a sensing gate line after the black gate pulse is output in the third period C of one frame period may differ from a period until the sensing gate pulse is output to another sensing gate line after the black gate pulse is output in the third period C of one other frame period.

To provide an additional description, only one sensing gate pulse may be output in the third period C of one frame period, and a time, at which the sensing gate pulse is output after the black gate pulse is output in the third period C of one other frame period, may be set differently for each gate line.

However, the timing may not be set differently in all gate lines, and the above-described patterns may be repeated at certain periods.

In the present disclosure, the controller 400 may store pieces of information about timings shown in FIG. 10.

Therefore, the controller 400 may set a timing at which the sensing-enabled period SPP starts, based on the pieces of information about the timings and a sensing gate line on which sensing is to be performed, and may output the reset signal RESET to the third driver 210 according to the timing.

According to the present disclosure, a timing at which black image data voltages for outputting a black image are supplied to a panel and a timing at which sensing image data voltages for outputting a sensing image are supplied to the panel may be differently set, and thus, a function of outputting the black image and a function of sensing a driving transistor may all be performed in the vertical blank period.

The above-described feature, structure, and effect of the present disclosure are included in at least one embodiment of the present disclosure, but are not limited to only one embodiment. Furthermore, the feature, structure, and effect described in at least one embodiment of the present disclosure may be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the scope of the disclosure. Thus, it is intended that the present disclosure covers the modifications and variations of this disclosure provided they come within the scope of the appended claims.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An organic light emitting display apparatus, comprising:

an organic light emitting display panel including a plurality of pixels, each of the pixels including an organic light emitting diode and a driving transistor for driving the organic light emitting diode;

a gate driver configured to:

output image gate pulses, which control outputs of image data voltages used to display an image, to a plurality of gate lines included in the organic light emitting display panel in a first period of a first frame period, output the image gate pulses and black gate pulses for controlling outputs of black image data voltages used to display a black image in a second period of the first frame period that is subsequent to the first period, and output a sensing gate pulse to one gate line of the plurality of gate lines connected to driving transistors of a portion of the plurality of pixels, of which a characteristic variation is to be sensed, in a third period of the first frame period that is subsequent to the second period until a first period of a second frame period starts;

a data driver configured to output data voltages to a plurality of data lines included in the organic light emitting display panel; and a controller configured to control the gate driver and the data driver, wherein the gate driver comprises:

a first driver configured to generate the image gate pulses the black gate pulses, and the sensing gate pulse using a first set of gate docks provided by the controller in the first frame period;

a second driver configured to generate the image gate pulses, the black gate pulses, and the sensing gate pulse using a second set of gate clocks provided by the controller in the first frame period; and a third driver configured to control the first driver and the second driver to out output the sensing gate pulse in the third period of the first frame period, and wherein the third driver is configured to select a sensing gate line, to which the sensing gate pulse is to be output, from among the plurality of gate lines based on a line selection signal provided by the controller and to control the first driver or the second driver based on a reset signal provided by the controller so that the first driver or the second driver outputs the sensing gate pulse to the selected sensing gate line.

2. The organic light emitting display apparatus of claim 1, wherein the controller is configured to output the line selection signal to the third driver at a timing at which a gate clock, corresponding to an image gate pulse output to the sensing gate line in the first period or the second period of the first frame period, of the gate clocks is output to the first driver or the second driver.

3. The organic light emitting display apparatus of claim 1, wherein the controller is configured to select, as a sensing-enabled period, when the sensing gate pulse is output from the first driver, one period of a first sleeping period and to provide the reset signal, indicating the start of the sensing-enabled period, to the third driver, and wherein the first sleeping period is a period between a period in which the second driver outputs black gate pulses after the first driver is driven for outputting the black gate pulses and a period in which the first driver is again driven for outputting the black gate pulses, in the third period.

4. The organic light emitting display apparatus of claim 1, wherein the controller is configured to select, as a sensing-enabled period, when the sensing gate pulse is output from the second driver, one period of a second sleeping period and to provide the reset signal, indicating the start of the sensing-enabled period, to the third driver, and wherein the second sleeping period is a period between a period in which the first driver outputs black gate pulses after the second driver is driven for outputting the black gate pulses and a period in which the second driver is again driven for outputting the black gate pulses, in the third period.

5. The organic light emitting display apparatus of claim 1, wherein at least one of the first driver or the second driver is configured to simultaneously output the black gate pulses to eight gate lines of the plurality of gate lines.

6. The organic light emitting display apparatus of claim 1, wherein the first set of gate clocks includes first to eighth gate clocks, and the first driver is configured to generate the image gate pulses using the first to eighth gate clocks, and the second set of gate clocks includes ninth to sixteenth gate clocks, and the second driver is configured to generate the image gate pulses using the ninth to sixteenth gate clocks.

7. The organic light emitting display apparatus of claim 6, wherein an interval between a fourth image gate pulse and a fifth image gate pulse output from the first driver is greater than an interval between other consecutive image gate pulses output from the first driver, and an interval between a twelfth image gate pulse and a thirteenth image gate pulse output from the second driver is greater than an interval between other consecutive image gate pulses output from the second driver.

8. The organic light emitting display apparatus of claim 6, wherein the first driver is configured to output the black gate pulse in a period between a period in which the fourth gate clock is output and a period in which the fifth gate clock is output, and the second driver is configured to output the black gate pulse in a period between a period in which the twelfth gate clock is output and a period in which the thirteenth gate clock is output.

9. The organic light emitting display apparatus of claim 1, wherein the first driver and the second driver are configured to alternately output sixteen image gate pulses.

10. The organic light emitting display apparatus of claim 1, wherein the first driver and the second driver are configured to repeatedly perform a same function at a period corresponding to thirty-two image gate pulses.

11. The organic light emitting display apparatus of claim 1, wherein when the first driver and the second driver are configured to alternately output sixteen image gate pulses, the first driver and the second driver are configured to repeatedly perform a same function at a period corresponding to thirty-two image gate pulses, and a number of the gate lines is 2,160, and a period in which the gate pulses are output is expressed as 32n+16, where n is a natural number equal to or less than 67, and when n is 67, all of 2,160 gate pulses are output.

12. The organic light emitting display apparatus of claim 11, wherein the first driver is configured to output a first set of sixteen image gate pulses using first to eighth gate clocks, the second driver is configured to output a second set of sixteen image gate pulses ninth to sixteenth gate clocks, after the first driver outputs the first set of sixteen image gate pulses, the first driver is configured to output a third set of sixteen image gate pulses the first to eighth gate clocks, after the second driver outputs the second set of sixteen image gate pulses, and the second driver is configured to output a fourth set of sixteen image gate pulses using the ninth to sixteenth gate clocks, after the first driver outputs the third set of sixteen image gate pulses.

13. The organic light emitting display apparatus of claim 1, wherein the data driver is configured to output the image data voltages in the first period, to output the image data voltages or the black image data voltages in the second period, and to output sensing image data voltages for displaying a sensing image or the black image data voltages in the third period.

14. The organic light emitting display apparatus of claim 1, wherein the black gate pulses are output from the second period of the first frame period to at least part of a first period of the second frame period.

15. The organic light emitting display apparatus of claim 1, wherein a period until the sensing gate pulse is output to a sensing gate line after the black gate pulse is output in the third period of the first frame period differs from a period until the sensing gate pulse is output to another sensing gate line after the black gate pulse is output in a third period of the second frame period.

16. A device, comprising:

an organic light emitting display panel, including a plurality of gate lines extending in a first direction;

a plurality of data lines extending in a second direction transverse to the first direction; and a plurality of pixels respectively coupled to at least one of the plurality of gates lines and at least one of the plurality of data lines, each of the pixels including an organic light emitting diode and a driving transistor coupled to the organic light emitting diode;

a gate driver configured to:

output a first set of image gate pulses to a first set of the plurality of gate lines in a first portion of a first frame period, output a second set of image gate pulses to a second set of the plurality of gate lines, and output a black gate pulse for controlling outputs of black image data voltages used to display a black image to the first set of the plurality of gate lines in a second portion of the first frame period that is subsequent to the first portion, and output a sensing gate pulse to one gate line of the plurality of gate lines in a third portion of the first frame period that is subsequent to the second portion and prior to a first period of a second frame period;

a data driver configured to output data voltages to the plurality of data lines; and a controller configured to control the gate driver and the data driver, wherein the gate driver comprises:

a first driver configured to generate the first set of image gate pulses, the black gate pulses, and the sensing gate pulse using a first set of gate clocks provided by the controller in the first frame period;

a second driver configured to generate the second set of image gate pulses, the back gate pulses, and the sensing gate pulse using a second set of gate docks provided by the controller in the first frame period; and a third driver configured to control the first driver and the second driver to output the sensing gate pulse in the third period of the first frame period, and wherein the third driver is configured to select a sensing gate line, to which the sensing gate pulse is to be output, from among the plurality of gate lines based on a line selection signal provided by the controller and to control the first driver or the second driver based on a reset signal provided by the controller so that the first driver or the second driver outputs the sensing gate pulse to the selected sensing gate line.

* * * * *